US006634057B2

(12) United States Patent
Wartian

(10) Patent No.: US 6,634,057 B2
(45) Date of Patent: Oct. 21, 2003

(54) DOOR HOLDER ASSEMBLY

(76) Inventor: George Wartian, 34938 Island View Dr., Mount Clemons, MI (US) 48045

( * ) Notice: Subject to any disclaimer, the term of this patent is extended or adjusted under 35 U.S.C. 154(b) by 9 days.

(21) Appl. No.: 10/011,910

(22) Filed: Nov. 5, 2001

(65) Prior Publication Data

US 2003/0084539 A1 May 8, 2003

(51) Int. Cl.[7] ..... E05C 17/50
(52) U.S. Cl. ..... 16/66; 16/82; 16/84
(58) Field of Search ..... 16/66, 82, 84, 16/85, 297, 319, 321

(56) References Cited

U.S. PATENT DOCUMENTS 1,573,512 A * 2/1926 Bush ..... 292/275
3,110,924 A 11/1963 Wartian
3,161,909 A * 12/1964 Strauss ..... 16/70
3,267,513 A 8/1966 Wartian
4,639,969 A * 2/1987 Obenshain ..... 16/70
4,803,754 A * 2/1989 Roberts ..... 16/49
4,920,609 A * 5/1990 Lin ..... 16/66
5,157,806 A 10/1992 Wartian
5,495,639 A 3/1996 Wartian
5,529,148 A * 6/1996 O'Leary ..... 188/67
5,832,562 A * 11/1998 Luca ..... 16/71

* cited by examiner

*Primary Examiner*—Anthony Knight
*Assistant Examiner*—Doug Hutton
(74) *Attorney, Agent, or Firm*—Reising,Ethington,Barnes,Kisselle, P.C.

(57) ABSTRACT

A control assembly for holding a pivoted door in an open position and releasable to enable the door to swing to a closed position. A rotor is connected to the door in a manner such that when the door is opened the rotor is rotated in one direction to a locking position and when the door is closed the rotor is rotated in the opposite direction. A locking detent is engagable with the rotor to prevent the rotor from rotating in the opposite direction and thereby to hold the door open. The detent is retracted when the rotor is rotated past the locking position to a release position. The detent is held retracted until the rotor is rotated past the locking position enabling the door to close.

12 Claims, 3 Drawing Sheets

DOOR HOLDER ASSEMBLY

This invention relates to a control assembly for holding a pivoted door in an open position and releasable to enable the door to swing to a closed position.

BACKGROUND OF THE INVENTION

Typically, a swinging door such as a screen door or storm door, has a piston-cylinder type closer for controlling the closing movement of the door. Often a tab is provided on the rod of the piston-cylinder assembly to prevent the piston-cylinder assembly from contracting and thereby hold the door open. The tab may be moved to an operative or inoperative position, as desired. To move the tab usually requires a person to bend over and manually alter the position of the tab. What is needed is a means for automatically holding the door open and which is easily and quickly releasable when it is desired not to hold the door open or when it is desired simply to close the door.

SUMMARY OF THE INVENTION

In accordance with the present invention, a control assembly, including a rotor, is connected to the door in a manner such that when the door is swung to its open position the rotor is rotated in one direction to a locking position and when the door is swung to its closed position the rotor is rotated in the opposite direction. A locking detent is engagable with the rotor when the rotor is in the locking position to hold the door open. The detent is retracted when the door is swung further in an opening direction, causing the rotor to rotate to a release position. The detent is held retracted allowing the door to close. In accordance with the specific embodiment disclosed herein, the door is held open by a finger on the detent extending into a finger-receiving recess in the rotor, and the detent is retracted by a cam on the rotor. Further in accordance with the invention, a spring is provided for engaging a notch in the detent to hold the detent retracted. The spring is normally out of contact with the detent but is pressed into engagement with the notch in the detent by a part on the rotor when the rotor is rotated to its release position.

One object of this invention is to provide a control assembly for a door having the foregoing features and capabilities.

Another object is to provide a control assembly which is composed of a relatively few simple parts, is rugged and durable in use, and can be inexpensively manufactured and easily installed and operated.

These and other objects, features and advantages of the invention will become more apparent as the following description proceeds, especially when considered with the accompanying drawings.

DETAILED DESCRIPTION OF THE PREFERRED EMBODIMENT

Figure 1:
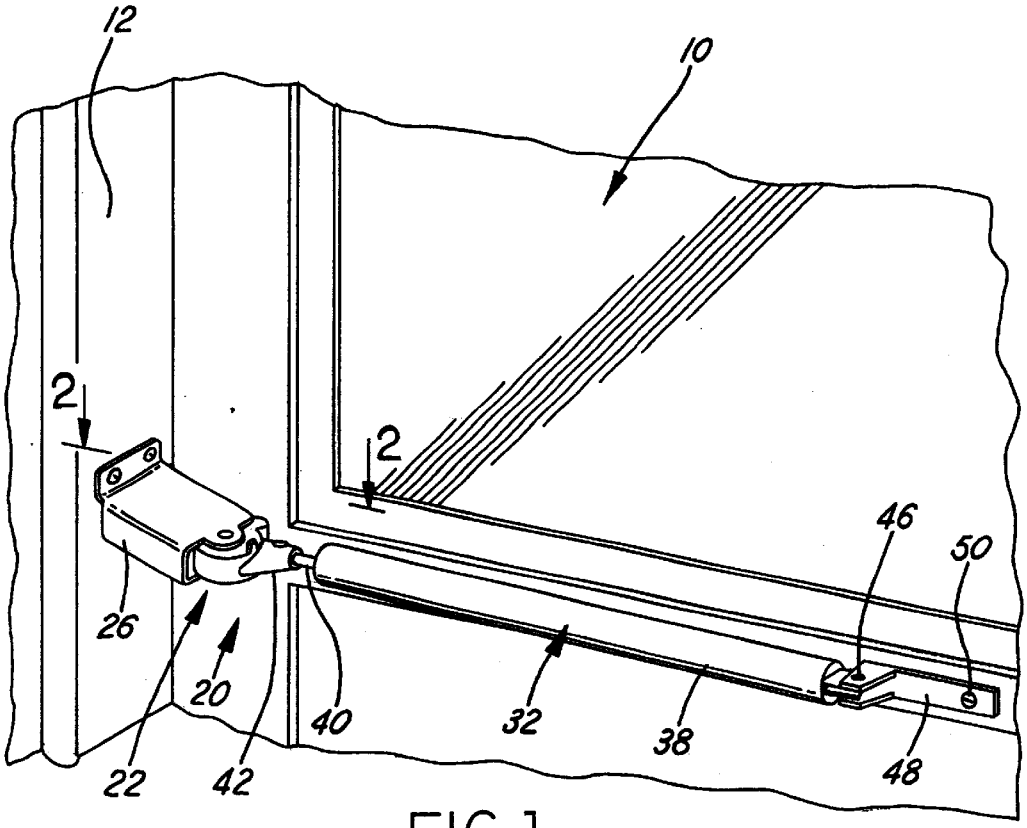
FIG. 1 is a fragmentary perspective view showing a door in the closed position and a control assembly for the door, constructed in accordance with the invention.
Figure 2:
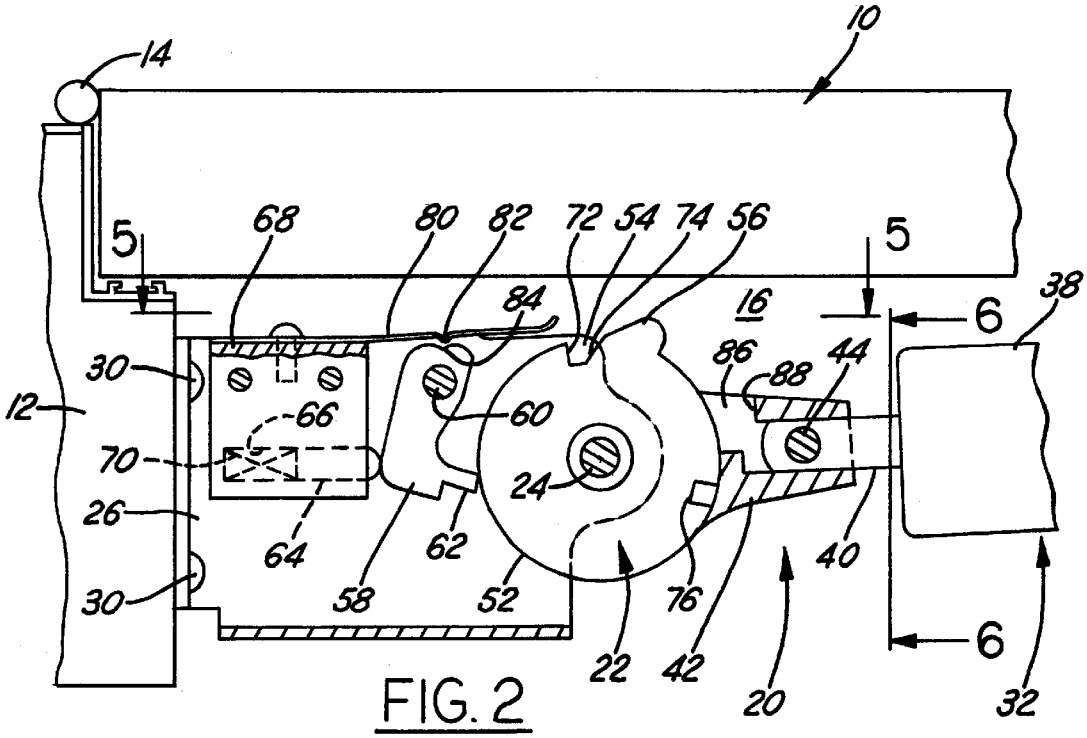
FIG. 2 is a sectional view taken on the line 2—2 in FIG. 1.
Figure 3:
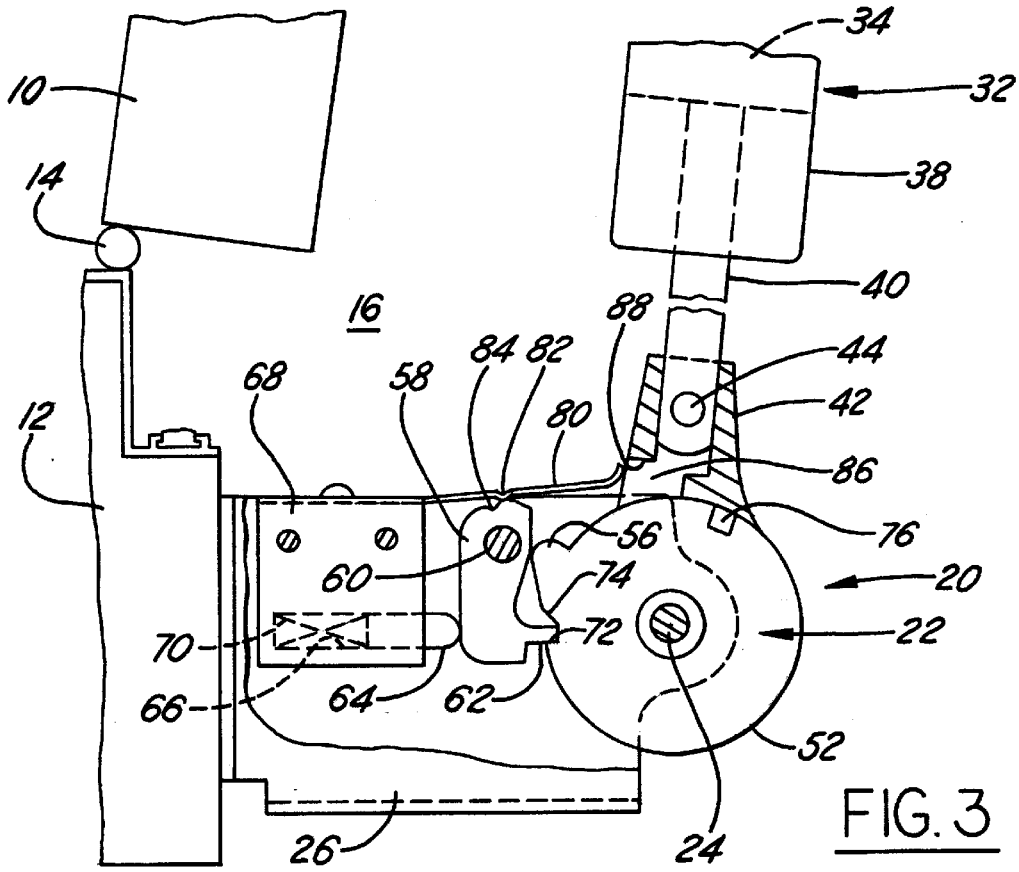
FIG. 3 is a view similar to FIG. 2 but with the door open and the parts of the control assembly in another position.
Figure 4:
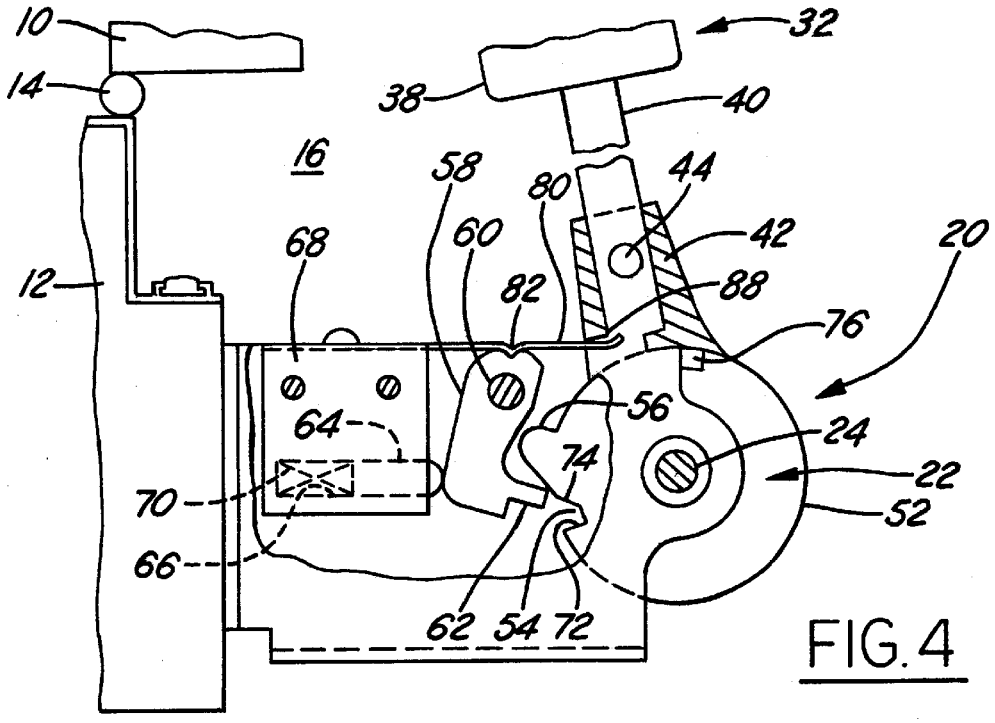
FIG. 4 is a view similar to FIG. 2 but with the door open and the parts of the control assembly in still another position.
Figure 5:
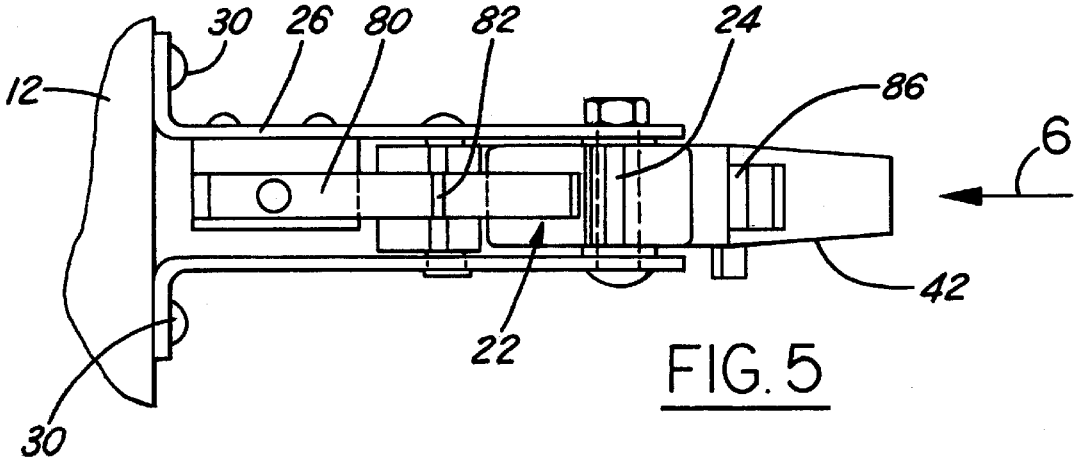
FIG. 5 is a view taken on the line 5—5 in FIG. 2.
Figure 6:
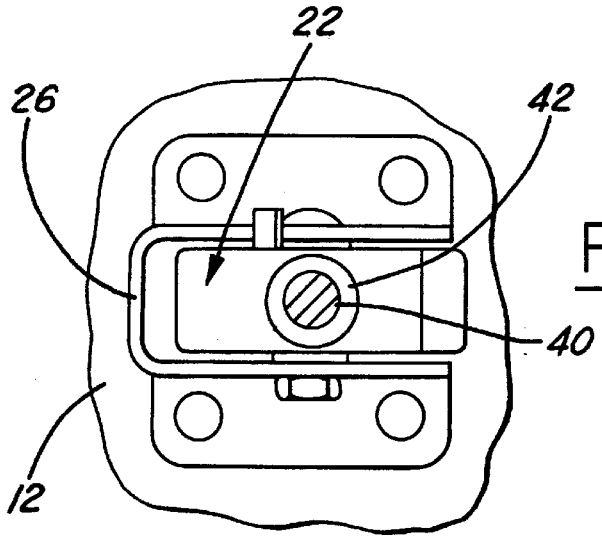
FIG. 6 is a sectional view taken on the line 6—6 in FIG. 2.
Figure 8:
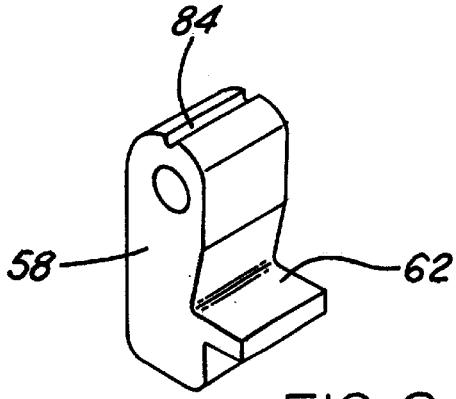
FIG. 8 is a perspective view of the locking detent also forming part of the control assembly.
Figure 7:
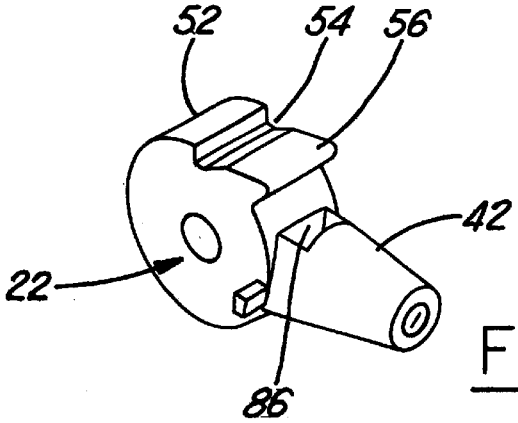
FIG. 7 is a perspective view of the rotor forming part of the control assembly.

Referring now more particularly to the drawings, a door 10 is shown connected to a doorframe 12 by a hinge 14 for swinging movement on the pivot axis of the hinge from the closed position shown in FIGS. 1 and 2 to an open position shown in FIGS. 3 and 4 with respect to the opening 16 defined by the doorframe. A control assembly 20 is provided for holding the door in an open position and which is releasable to enable the door to swing on its pivot axis to the closed position.

The control assembly 20 includes a rotor 22 mounted for rotation by a pivot pin 24 in a housing 26 which is secured to the frame 12 by fasteners 30.

The control assembly 20 also includes a piston-cylinder assembly 32 which has a piston 34 axially slidable within an elongated cylinder 38. A piston rod 40 secured to the piston extends lengthwise within the cylinder 38 and has an outwardly projecting end secured to a boss 42 on the rotor 22 by a pin 44. The end of the cylinder 38 opposite to the projecting end of the piston rod 40 is pivotally secured by a pin 46 to a bracket 48 which in turn is secured to the door 10 by fasteners 50.

Referring to FIGS. 2–4, the surface 52 of the rotor, except for the boss 42, a recess 54 and a cam 56 to be described more fully hereinafter, is circular.

A locking detent 58 is pivoted to the housing 26 by a pin 60. The detent 58 has a finger 62 which is held in contact with the surface 52 of the rotor 22 by a plunger 64 slidable in a bore 66 in a block 68 secured to the housing 26. A spring 70 in the bore 66 presses the plunger against the rotor surface 52.

The recess 54 in the rotor 22 is adapted to receive the finger 62 of the detent 58. One side 72 of the recess 54 extends generally radially to prevent clockwise rotation of the rotor 22 when the finger 62 is in the recess. The opposite side 74 of the recess 54 is slanted or inclined to cam the finger our of the recess and rotate or retract the detent clockwise when the rotor turns counterclockwise as in FIG. 4. The cam 56 on the rotor 22 will rotate the detent 58 further clockwise as a result of further counterclockwise rotation of the rotor, to a point where the tip of the finger 62 is radially outwardly of the arc of the surface 52 of the rotor. A stop 76 on the rotor 22 is engagable with the housing 26 to prevent counterclockwise rotation of the rotor beyond the FIG. 4 position.

An elongated leaf spring 80 is secured to the block 68. The leaf spring has a V-shaped projection 82 engagable in a notch 84 in the detent. Normally the leaf spring 80 is in an unstressed or free state condition as in FIG. 3 in which it is out of contact with the detent. The boss 42 on the rotor has an opening 86 the top surface 88 of which is engagable with the end of the leaf spring 80 to press the leaf spring down against the detent when the rotor is rotated from the FIG. 3 position to the FIG. 4 position.

Describing the operation of the control assembly, let it be assumed that the door 10 is closed and the control assembly 20 is in the position shown in FIG. 2 with the detent 58 pressed by the plunger 64 in a counterclockwise direction causing the finger 62 to engage the circular surface 52 of the rotor. To open the door, the door is rotated on its hinge 14 counterclockwise, causing counterclockwise rotation of the rotor. When the door is fully open as in FIG. 3, the detent 58, pressed by the plunger 64, is rotated counterclockwise causing its finger 62 to engage in the recess 54 of the rotor. The radial side 72 of the recess contacts the finger to prevent the rotor from reverse rotating clockwise and thereby holds the door open. This is the locking position of the rotor.

When it is desired to close the door, the door is turned further counterclockwise to the FIG. 4 position causing the rotor 22 to rotate counterclockwise past the locking position of FIG. 3 to a release position shown in FIG. 4. The finger 62 of the detent is cammed out of the recess by the side 74 of the recess, retracting the detent clockwise. Further counterclockwise rotation of the rotor causes the cam 56 on the rotor to rotate or retract the detent still further clockwise as shown in FIG. 4, so that the tip of the finger is radially outwardly of the arc of the surface 52 of the rotor. At this time the free end of the leaf spring 80 extends into the opening 86 in the boss 42 on the rotor and is pressed down by the top surface 88 of the opening 86 to cause the projection 82 of the leaf spring to engage the notch 84 in the detent and hold the detent retracted. The door may now be moved to closed position and the rotor may turn freely clockwise far enough so that the recess 54 will pass the finger 62 and the finger will engage the circular surface 52 of the rotor before the leaf spring 80 is disengaged by the top surface 88 of the opening in the boss 42 of the rotor.

What is claimed is:

1. A control assembly for holding a pivoted door in an open position and releasable to enable the door to swing on a pivot axis to a closed position, comprising, a rotor, means connecting said rotor to the door in a manner such that when the door is swung to the open position the rotor is rotated in one direction to a locking position and when the door is swung to the closed position the rotor is rotated from said locking position in a direction opposite said one direction, a locking detent having a part engagable with a complementary part on said rotor when the rotor is rotated in said one direction to said locking position to prevent the rotor from rotating in said opposite direction and thereby to hold the door in the open position thereof, means for retracting the detent away from the rotor to disengage said parts when the rotor is rotated in said one direction past said locking position to a release position, and means for holding said detent retracted until the rotor is rotated in the opposite direction from the release position past the locking position to permit the door to swing to the closed position thereof.

2. The control assembly of claim 1, wherein said means for retracting the detent comprises a cam on said rotor.

3. The control assembly of claim 2, wherein said parts comprise a finger on said detent and a finger-receiving recess in the rotor.

4. The control assembly of claim 3, further including resilient means urging the detent in a direction to engage said finger into said recess.

5. The control assembly of claim 2, wherein the means for holding the detent retracted includes a spring engagable with a notch in the locking detent.

6. The control assembly of claim 5, wherein said spring normally extends away from said locking detent but is urged into engagement with said notch by a part on said rotor when said rotor is rotated to its release position.

7. The control assembly of claim 6, wherein the parts comprise a finger on said detent and a finger-receiving recess in the rotor, and further including resilient means urging the detent in a direction to engage the finger in the recess.

8. The control assembly of claim 1, wherein said rotor is mounted for rotation on a second pivot axis spaced from the pivot axis of the door, and further including a piston-cylinder assembly having a piston axially slidable within an elongated cylinder member and a rod member extending from said piston, and means connecting one of said members to said rotor and the other of said members to the door.

9. The control assembly of claim 8, wherein said means for retracting the detent comprises a cam on said rotor.

10. The control assembly of claim 9, wherein the means for holding the detent retracted includes a spring engagable with a notch in the locking detent.

11. The control assembly of claim 10, wherein said spring normally extends away from said locking detent but is urged into engagement with said notch by a part on said rotor when said rotor is rotated to its release position.

12. The control assembly of claim 11, wherein the parts comprise a finger on said detent and a finger-receiving recess in the rotor, and further including resilient means urging the detent in a direction to engage the finger in the recess.

* * * * *